US006999058B1

(12) United States Patent
Yano et al.

(10) Patent No.: US 6,999,058 B1
(45) Date of Patent: Feb. 14, 2006

(54) POWER SUPPLY CIRCUIT FOR DRIVING LIQUID CRYSTAL DISPLAY DEVICE

(75) Inventors: Takakazu Yano, Tokyo (JP); Shigeru Morokawa, Higashiyamato (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/492,789

(22) Filed: Jan. 28, 2000

(30) Foreign Application Priority Data

Jan. 29, 1999 (JP) ..... 11-021534

(51) Int. Cl.
*G09G 3/28* (2006.01)

(52) U.S. Cl. ..... 345/101; 345/211; 345/690

(58) Field of Classification Search ..... 345/211, 345/208–210, 94–100, 101–102, 212, 690, 345/87–89
See application file for complete search history.

(56) References Cited

U.S. PATENT DOCUMENTS 3,956,661 A * 5/1976 Sakamoto et al. ..... 327/513
4,198,581 A * 4/1980 Ahmed ..... 327/65
4,297,697 A * 10/1981 Mitsui ..... 345/212
4,319,237 A * 3/1982 Matsuo et al. ..... 345/101
4,390,874 A * 6/1983 Woodside et al. ..... 345/101
4,570,115 A * 2/1986 Misawa et al. ..... 323/313
4,582,395 A * 4/1986 Morozumi ..... 349/43
4,621,260 A * 11/1986 Suzuki et al. ..... 345/92
4,622,635 A * 11/1986 Chandra et al. ..... 700/84
4,677,850 A * 7/1987 Miura et al. ..... 73/204.15
4,687,956 A * 8/1987 Itoh et al. ..... 327/108
4,807,972 A * 2/1989 Klosterboer ..... 345/101
4,923,285 A 5/1990 Ogino et al. ..... 350/331
5,250,937 A * 10/1993 Kikuo et al. ..... 345/89

(Continued)

FOREIGN PATENT DOCUMENTS

EP 0 314 084 5/1989

(Continued)

OTHER PUBLICATIONS

The Electrical Engineering Handbook, CRC Press, 1993, p. 545-580.*

*Primary Examiner*—Amr A. Awad
(74) *Attorney, Agent, or Firm*—Finnegan, Henderson, Farabow, Garrett & Dunner, L.L.P.

(57) ABSTRACT

A power supply circuit having a data driver power circuit, which has a temperature compensation function and a voltage regulation function, and a scan driver power circuit that has a function of controlling the brightness of the liquid crystal display device as a user desires. The data driver power circuit of the power supply circuit has a diode group and an electric current limiting resistor so that the data drive voltage is 3.6 V or so at room temperature.

4 Claims, 7 Drawing Sheets

U.S. PATENT DOCUMENTS 5,307,084 A * 4/1994 Yamaguchi et al. ..... 345/58
5,379,003 A * 1/1995 Bizen ..... 331/117 R
5,419,199 A * 5/1995 Araki ..... 73/708
5,473,289 A * 12/1995 Ishizaki et al. ..... 331/176
5,663,743 A * 9/1997 Fujii et al. ..... 345/95
5,739,805 A * 4/1998 Dingwall ..... 345/100
5,745,092 A * 4/1998 Ito ..... 345/95
5,831,588 A * 11/1998 Hotto ..... 345/100
5,852,430 A * 12/1998 Endo ..... 345/101
5,929,828 A * 7/1999 Beeteson et al. ..... 345/74.1
6,107,985 A * 8/2000 Walukas et al. ..... 345/102
6,115,021 A * 9/2000 Nonomura et al. ..... 345/101
6,121,943 A * 9/2000 Nishioka et al. ..... 345/76
6,177,915 B1 * 1/2001 Beeteson et al. ..... 345/87
6,236,394 B1 * 5/2001 Ikeda ..... 345/211

FOREIGN PATENT DOCUMENTS

JP 03036519 A * 2/1991 ..... 345/101

* cited by examiner

PRIOR ART

PRIOR ART

POWER SUPPLY CIRCUIT FOR DRIVING LIQUID CRYSTAL DISPLAY DEVICE

BACKGROUND OF THE INVENTION

1. Field of the Invention

The present invention relates to a power supply circuit for driving a liquid crystal display device.

2. Description of the Related Art

FIG. 1 shows the constitution of an example of a conventional power supply circuit for supplying electric power to, and driving, a passive matrix liquid crystal display device that is driven by a data drive circuit and a scan drive circuit. The power supply circuit of this example is operative to supply a data drive voltage to the data drive circuit. In FIG. 1, reference character 501 designates an input power supply. The value of a voltage supplied from this input power supply 501 is 6 V±1V or so.

Further, reference characters 502 and 504 denote resistors. Reference character 503, 505, 506, and 507 respectively designate a variable resistor, a diode group, a transistor, and a data drive voltage for driving a data drive circuit of the liquid crystal display device. Reference characters 508 and 509 denote capacitors. The resistor 502, the variable resistor 503, the resistor 504, and the diode group 505 are connected in series in this order. A terminal of the upper resistor 502 is connected to the input power supply 501. A cathode of the diode group 505 is connected to the ground.

The transistor 506 is an ordinary bipolar transistor. The collector, base, emitter of this transistor 506 are connected to the input power supply 501, a sliding terminal of the variable resistor 503, and a terminal of the capacitor 509, respectively. The other terminal of this capacitor 509 is connected to the ground. Furthermore, the capacitor 508 is connected between the base of the transistor 506 and the ground.

The data drive voltage 507 corresponds to a voltage for driving the liquid crystal display device. The upper resistor 502 is used for determining an upper limit of the data drive voltage 507, while the lower resistor 504 is used for determining a lower limit of the data drive voltage 507. Moreover, the variable resistor 503 is used for regulating a base current of the transistor 506.

The diode group 505 consists of two silicon diodes connected in series with each other and is provided for compensating for the temperature characteristic of the liquid crystal display device. That is, when a user changes a resistance value of the variable resistor 503, the data drive voltage 507 is regulated at a low current within a voltage range limited by the upper resistor 502 and the lower resistor 504. Thus, the brightness of the liquid crystal display device is controlled.

Furthermore, a scan drive voltage (not shown) outputted from the scan drive circuit for driving the liquid crystal display device is constant.

FIG. 2 is a graph illustrating brightness control ranges for controlling the characteristics of the liquid crystal display device, which include the brightness and the temperature characteristic thereof, in the case of using the conventional power supply circuit. FIG. 2 shows curves (namely, T-V curves) representing the dependence of the transmittance of the liquid crystal display device on the root mean square value of a voltage (level of a video signal) at certain temperatures in a normally white mode. In FIG. 2, reference characters 601, 602, 603, 604, 605, and 606 denote a high-temperature operating range, a low-temperature operating range, an automatic temperature correction range, a room-temperature operating range (indicated by a solid curve), a high-temperature T-V curve (indicated by a one-dot chain curve), and a low-temperature T-V curve (indicated by a two-dot chain curve), respectively. The room-temperature T-V curve 604 is a T-V curve obtained at a temperature of 20° C., and commences falling when the root mean square value of the voltage is about 1.9 (Vrms), and ceases falling when the root mean square value of the voltage is about 2.2 (Vrms).

The low-temperature T-V curve 606 is a T-V curve obtained at a temperature of 0° C., and commences falling when the root mean square value of the voltage is about 2.0 (Vrms), and ceases falling when the root mean square value of the voltage is about 2.3 (Vrms). The high-temperature T-V curve 605 is a T-V curve obtained at a temperature of 40° C., and commences falling when the root mean square value of the voltage is about 1.8 (Vrms), and ceases falling when the root mean square value of the voltage is about 2.1 (Vrms).

The low-temperature operating range 602 indicates a range for controlling the brightness of the liquid crystal display device at a temperature of 0° C. by using the power supply circuit shown in FIG. 1. Further, the high-temperature operating range 601 indicates a range for controlling the brightness of the liquid crystal display device at a temperature of 40° C. by using the power supply circuit shown in FIG. 1. The automatic temperature correction range 603 indicates a range for automatically correcting the brightness of the liquid crystal display device according to the temperature characteristic of the diode group 505 shown in FIG. 1.

Both of the low-temperature operating range 602 and the high-temperature operating range 601 are determined by the variable resistor 503 shown in FIG. 1. The difference between the low-temperature operating range 602 and the high-temperature operating range 601 depends upon the automatic temperature correction range 603.

In the case of the power supply circuit shown in FIG. 1, the operating ranges are increased by using the variable resistor 503, whose resistance is largely variable, so as to compensate for a range change caused according to the temperature characteristic of the liquid crystal display device. Thus, fine adjustment of the data drive voltage 507 cannot be achieved. Moreover, the range of the data drive voltage 507 changes with production variations in the input power supply.

Further, the division of the input power supply 501 by, for instance, resistance division using the upper resistor 502 and the lower resistor 504 reduces the significance of a voltage change caused by the temperature of the diode group 505 for temperature compensation.

Furthermore, an optimum value of the data drive voltage 507 is twice a voltage close to a threshold voltage (VthLCD) of the liquid crystal of the device, at which the optical characteristics thereof abruptly change. Therefore, it is inadvisable that a user controls the data drive voltage 507 by adjusting the variable resistor 503.

SUMMARY OF THE INVENTION

An object of the present invention is to provide a stable power supply circuit which can automatically control the brightness of a liquid crystal display device.

To achieve the foregoing object, according to the present invention, there is provided a power supply circuit which has a scan driver power circuit for supplying a scan drive voltage to a scan driver for scanning a liquid crystal display device and which has a data driver power circuit for supplying a data drive voltage to a data driver for sending display data to the liquid crystal display device. The data driver power circuit comprises an input power supply serving as a universal power supply therefor, an amplifying element having an input terminal connected to the input power supply, and having a control terminal, and an output terminal from which the data driver power voltage is outputted, an electric current limiting resistor having a first terminal connected to the input power supply, and having a second terminal connected to the control terminal of the amplifying element, and a diode group including a plurality of series-connected diodes each having a cathode terminal connected to the control terminal of the amplifying element, and having an anode terminal connected to the ground.

Further, in this power supply circuit, the scan driver power circuit comprises an input power supply serving as a universal power supply therefor, an amplifying element having an input terminal connected to the input power supply, and having a control terminal, and an output terminal from which the data driver power voltage is outputted, a divider circuit, provided between the input power supply and the ground, for setting an upper limit value of a voltage applied to the control terminal of the amplifying element, and a variable resistor having a resistance variation terminal connected to the control terminal of the amplifying element. The variable resistor is operative to vary a voltage appearing at the output terminal of the amplifying element by changing a voltage applied to the control terminal of the amplifying element.

The divider circuit of the scan driver power circuit comprises a resistor having a terminal connected to the input power supply, and comprises a Zener diode having a cathode connected to the resistor and having an anode connected to the ground. Moreover, a terminal of the variable resistor may be connected to the cathode of the Zener diode.

Furthermore, the data drive voltage may be within a range of a voltage, which is lower than a threshold voltage of a liquid crystal used in said liquid crystal display device by 20% of the threshold voltage, to a voltage that is higher than the threshold voltage thereof by 20% of the threshold voltage. Alternatively, the data drive voltage may be within a range of a peak to peak voltage of a signal, which is inputted to the data driver, ±20% thereof. Further, the number of diodes of the diode group may be 7.

Incidentally, the diodes of the diode group may be silicon diodes. The resistance of the current limiting resistor may be within a range of 40 kΩ to 50 kΩ. Additionally, each of the amplifying elements may be a bipolar transistor, a field effect transistor, a MOS transistor, or an operational amplifier.

According to the present invention, a temperature compensation function and a voltage regulation function are provided by the data driver power circuit. A function of controlling the brightness as a user desires is provided to the scan driver power circuit. Further, according to the present invention, the data driver power circuit has the diode group and the current limiting resistor so that the data drive voltage is 3.6 V or so at room temperature.

This is because of the fact that the root mean square value of the threshold voltage (VthLC) of most of liquid crystals is 1.8 to 2.0 (Vrms) or so and that it is, therefore, advisable to set the data drive voltage at 3.6 to 4.0 (Vrms), which is twice the value of such a threshold voltage. Further, the power supply circuit of the present invention has an advantage in that this power supply circuit may be used in common as a power supply for driving a logic portion of the data driver power circuit.

BRIEF DESCRIPTION OF THE DRAWINGS

Other features, objects and advantages of the present invention will become apparent from the following description of preferred embodiments after reference to the drawings in which like reference characters designate like or corresponding parts throughout several views and in which.

DETAILED DESCRIPTION OF THE PREFERRED EMBODIMENTS

Figure 3A:
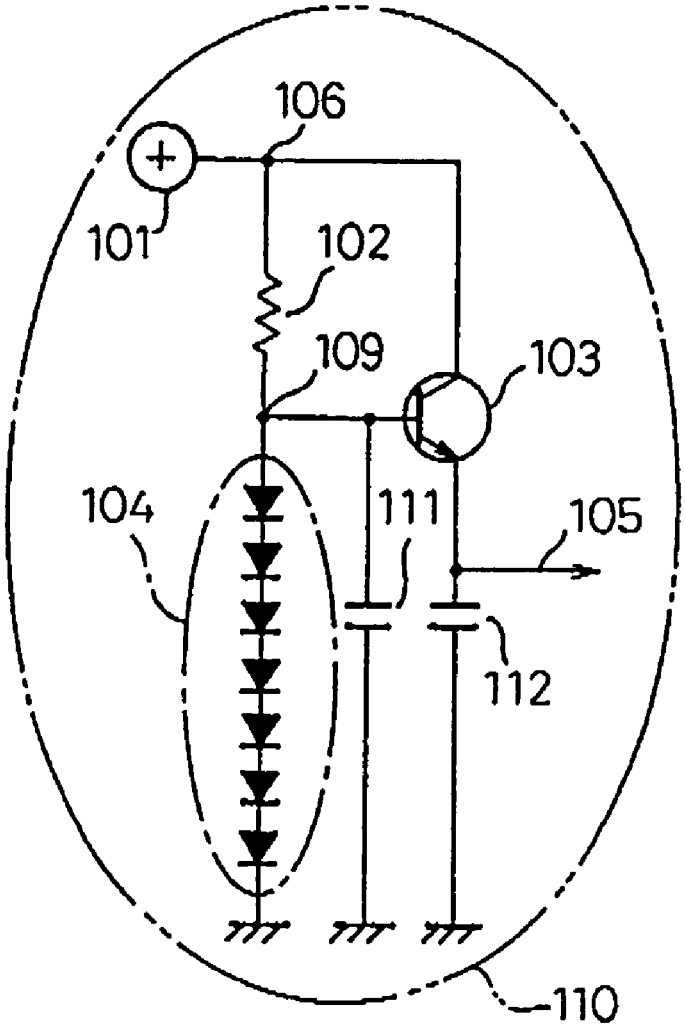
FIG. 3A is a circuit diagram showing the constitution of a data driver power circuit of a power supply circuit for driving a liquid crystal display device according to the present invention.

FIG. 3A is a circuit diagram showing the constitution of a data driver power circuit 110 for driving a liquid crystal display device according to the present invention. In FIG. 3A, reference character 101 designates an input power supply. This input power supply 101 serves as a universal power supply for the data driver power circuit 110 that acts as a power circuit for the data drive circuit. The voltage supplied from the input power supply 101 is 6 V±1 V or so.

Further, reference character 102, 103, 104, and 105 designate a resistor, a transistor, a diode group, and a data drive voltage for driving a data drive circuit of a liquid crystal display device, respectively. Reference characters 106 and 109 denote junctions. Reference characters 111 and 112 designate capacitors. The resistor 102 and the diode group 104 are connected in series at a junction 109. A terminal of the resistor 102 is connected to a junction 106 that is connected to an input power supply 101. A cathode of a diode group 104 is connected to the ground.

The transistor 103 is an ordinary bipolar transistor. The collector, base, and emitter of the transistor 103 are connected to the junction 106, the junction 109, and the ground through the capacitor 112, respectively. A data drive voltage 105 is outputted from the connecting point between the capacitor 112 and the emitter of the transistor 103. Further, the capacitor 111 is connected between the base of the transistor 103 and the ground. The bipolar transistor 103 outputs the data drive voltage 105 to the emitter thereof according to the voltage at the junction 109.

The capacitor 111 is provided so as to stabilize the base voltage of the transistor 103. The capacitor 112 is provided so as to stabilize the data drive voltage 105.

The diode group 104 consists of seven series-connected silicon diodes, whose threshold voltage (VthSi) is about 0.6 V at room temperature. This diode group 104 is provided so as to set the voltage at the junction 109 set at 4.2 V at room temperature. The electric current limiting resistor 102 is provided so as to obtain a stable diode characteristic region, and is set within a range of 40 kΩ to 50 kΩ. Thus, the current limiting resistor 102 limits electric current flowing from the junction 106 to the diode group 104.

With this constitution, at room temperature, the data drive voltage 105 becomes about 3.6 V, since it is obtained by subtracting a voltage drop of about 0.6 v between the base and the emitter of the transistor 103 from a voltage of 4.2 V at the diode group 104.

Incidentally, the temperature dependency of the threshold voltage (VthSi) of the silicon diode is usually 2 mV/° C. or so. Thus, the data drive voltage 105 is 3.8 V or so at a temperature of 0° C. Further, at a temperature of 40° C., the data drive voltage is 3.4 V. This is in close agreement with the temperature characteristic of the ordinary liquid crystal.

Further, it has already been explained that if half of the data drive voltage 105 is close to the threshold voltage (VthLCD) of a liquid crystal, at which the optical properties of the liquid crystal abruptly changes, the contrast of a liquid crystal display device is improved. Most of the threshold voltages (VthLCD) range from 1.8 V to 2.0 V at room temperature. In view of such facts, this voltage, which is 3.6 V or so at room temperature as described above, is suitable.

Figure 3B:
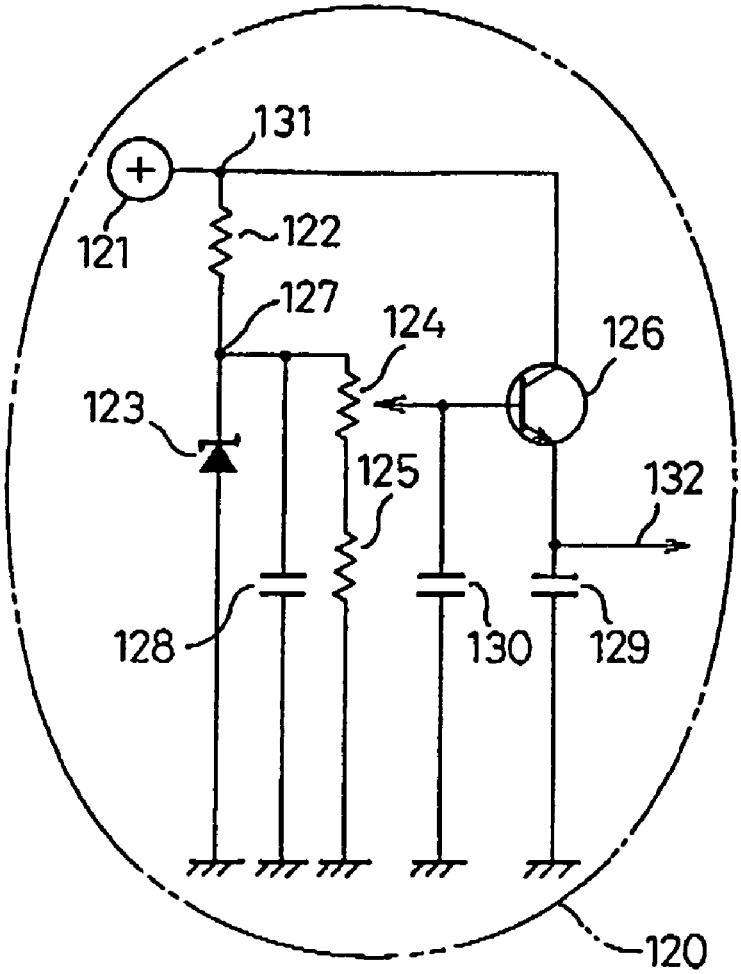
FIG. 3B is a circuit diagram showing the constitution of a scan driver power circuit of the power supply circuit for driving the liquid crystal display device according to the present invention.

FIG. 3B is a circuit diagram showing the constitution of a scan driver power circuit 120 for driving a liquid crystal display device according to the present invention. In FIG. 3B, reference character 121 designates an input power supply. This input power supply 121 serves as a universal power supply for the scan driver power circuit 120. A voltage supplied from the input power supply 121 is 25 V±1 V or so.

Further, reference characters 122 and 125 denote resistors. Reference characters 123, 124, and 126 designate a Zener diode, a variable resistor, and a transistor, respectively. Reference characters 127 and 131 denote junctions. Reference characters 128 to 130 designate capacitors. Reference character 132 denotes a scan drive voltage for driving the scan drive circuit of the liquid crystal display device. The resistor 122 is connected between the junctions 127 and 131. The zener diode 123, the capacitor 128, and a series circuit consisting of the variable resistor 124 and the resistor 125 connected in series are connected in parallel between the junction 127 and the ground.

The transistor 126 is an ordinary bipolar transistor. The collector, base, emitter of this transistor 126 are connected to the input power supply 131, a sliding terminal of the variable resistor 124, and the ground through the capacitor 129, respectively. A scan drive voltage 132 is outputted from a connecting point between this capacitor 129 and the emitter of the transistor 126. Furthermore, the capacitor 130 is connected between the base of the transistor 126 and the ground. The transistor 126 outputs from the emitter thereof the scan drive voltage 132 corresponding to the base voltage thereof.

The Zener diode 123 and the resistor 122 are provided so as to regulate the voltage, which is supplied from the input power supply 121, at the junction 127. The variable resistor 124 is provided so as to vary the base voltage of the transistor 126 within a range between an upper limit voltage, which is determined-b the zener diode 123, and a lower limit voltage, which is determined by the resistor 125.

The capacitor 128 is provided so as to stabilize the regulation voltage provided by the Zener diode 123. Further, the capacitor 130 is provided so as to stabilize the base voltage of the transistor 126. Moreover, the capacitor 129 is provided so as to stabilize the scan drive voltage 132.

With this constitution, when a user changes the base voltage of the transistor 126 by manipulating the variable resistor 124, the scan drive voltage 132 stably varies in response thereto.

Figure 4:
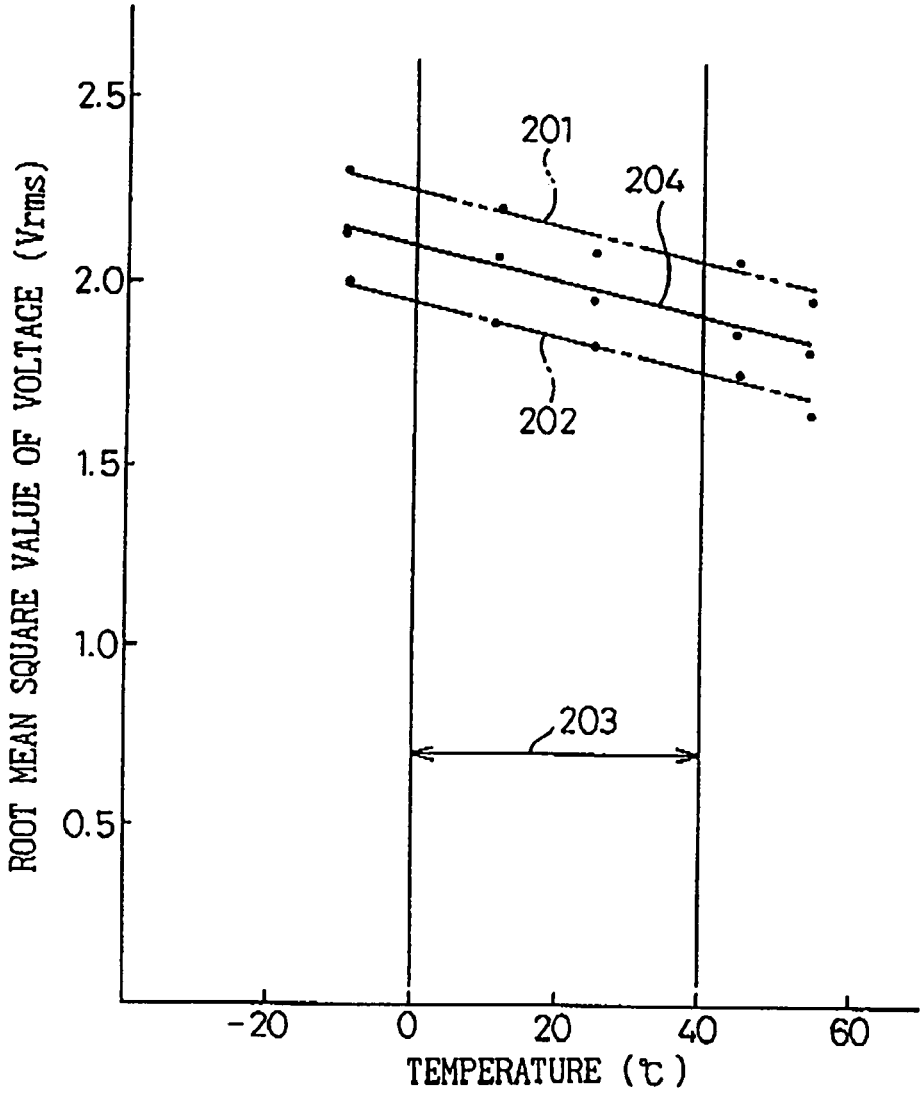
FIG. 4 is a graph showing the characteristic relationship between the root mean square value of the voltage (level of a video signal) for illustrating the dependence of the root mean square value of the voltage on temperature in the power supply circuit of the present invention.

FIG. 4 is a graph showing temperature characteristic measured when ambient temperature was changed from about −10° C. to about 50° C. in the case that a passive matrix liquid crystal display device, whose screen was split into 160 regions, was driven at the data drive voltage and the scan drive voltage, which were respectively generated by the power circuits of FIGS. 3A and 3B. Incidentally, after the data drive voltage 105 and the scan drive voltage 132 were measured, the root mean square value of the voltage (level of a video signal) was obtained by the following equation generally known as used for calculation of an effective value of a driving voltage for a liquid crystal display device:

$$Vrms=\sqrt{Vs^2+(Vt^2-Vs^2)/n}$$

where Vs designates half of the data drive voltage, and Vt indicates the scan drive voltage 132, and n denotes the number of regions into which the screen is split and is 160 in this case.

The data drive voltage 105 changed from about 3.8 v to about 3.4 V when the ambient temperature was changed from 0° C. to 40° C. At each temperature, when the scan drive voltage 132 was about 18V, the entire screen was black. When the scan drive voltage 132 was about 11 V, the entire screen was white. When the scan drive voltage 132 was about 14V, an image was normally displayed.

A two-dot chain curve 201, corresponding to the case in which the entire screen was black, indicates the root means square values of the voltage (level of a video signal) in the case that the display on the entire screen of the liquid crystal display device was black when the scan drive voltage was changed by operating the variable resistor 124. Further, a one-dot chain curve 202, corresponding to the case in which the entire screen was white, indicates the root means square values of the voltage (level of a video signal) in the case that the display on the entire screen of the liquid crystal display device was white when the scan drive voltage was changed by operating the variable resistor 124.

Moreover, a solid curve 204, corresponding to the case in which an image was normally displayed, indicates the root means square values of the voltage (level of a video signal) in the case that the image normally displayed on the entire screen of the liquid crystal display device was white when the scan drive voltage was changed by operating the variable resistor 124. The voltage of a range 203, in which the quality of the liquid crystal is assured to a change in temperature, ranges from 0° C. to 40° C., similarly as prescribed as a normal case.

The curve 201, corresponding to the case in which the entire screen was black, and the curve 202, corresponding to the case in which the entire screen was white, fall as the temperature rises. This is due to an amount of change in the data drive voltage 105, which is based on the temperature characteristic of the diode group 104 illustrated in FIG. 3A. Furthermore, the difference between the curves 201 and 202 is due to an amount of change in the scan drive voltage 132, which is caused by the variable resistor 124.

Incidentally, in the range of temperature of 0° C. to 40° C., the amount of change in the data drive voltage 105 due to the temperature characteristic of the diode group 104 is about 0.30 Vrms. The amount of change in the scan drive voltage 132 due to the variable resistor 124 is about 0.15 Vrms. These amounts of change in the voltages are significantly different from those of the conventional case.

Figure 5:
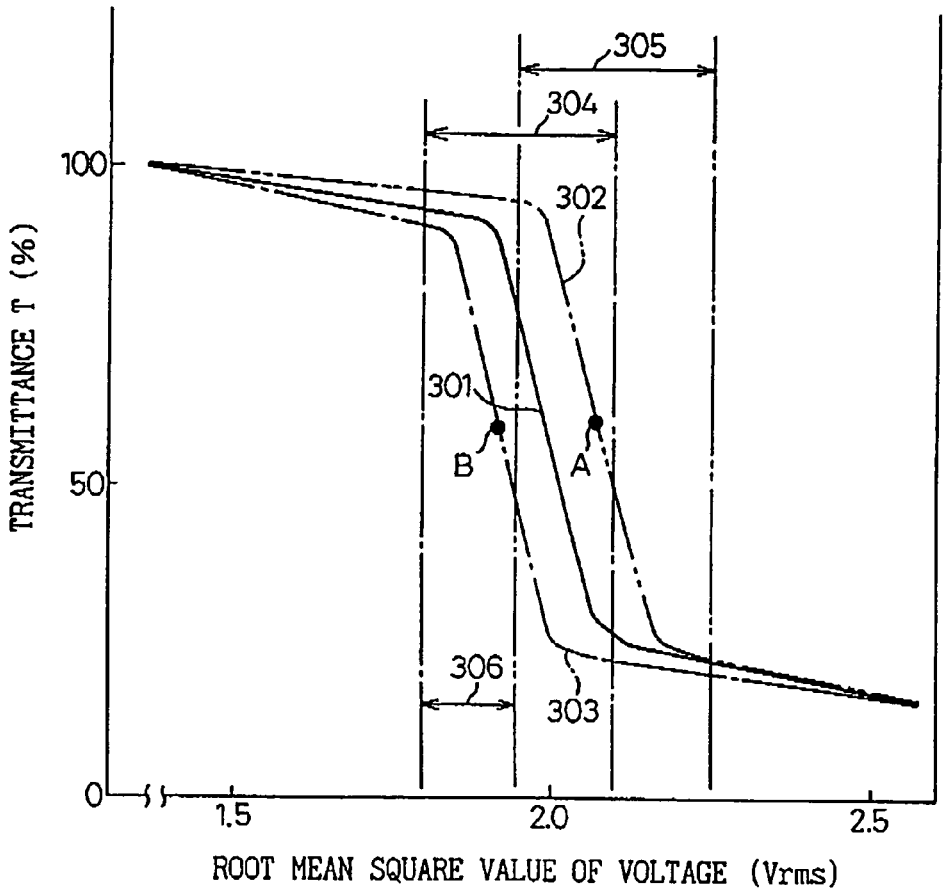
FIG. 5 is a graph showing characteristic curves, which are T-V curves of the liquid crystal display device employing a power supply circuit of the present invention, and high-temperature and low-temperature operating ranges respectively corresponding to the R-V curves of the liquid crystal display device employing the power supply circuit of the present invention.

FIG. 5 is a graph illustrating brightness control ranges for controlling the characteristics of the liquid crystal display device, which include the brightness and the temperature characteristic thereof, in the case of using the power circuits illustrated in FIGS. 3A and 3B, and showing curves (namely, T-V curves) representing the dependence of the transmittance of the liquid crystal display device on the root mean square value of a voltage (level of a video signal) at certain temperatures in a normally white mode. In this graph, the solid T-V curve measured at room temperature was obtained at a temperature of 20° C. The root mean square value of the voltage commences falling when the root mean square value of the voltage is about 1.9 (Vrms) and ceases falling when the root mean square value of the voltage is about 2.2 (Vrms).

The low-temperature T-V curve 302, which is indicated by a two-dot chain curve, was obtained at a temperature of 0° C. The root mean square value of the voltage (level of a video signal) commences falling when the root mean square value of the voltage is about 2.0 (Vrms) and ceases falling when the root mean square value of the voltage is about 2.3 (Vrms). The high-temperature T-V curve 303, which is indicated by a one-dot chain curve, was obtained at a temperature of 40° C. The root mean square value of the voltage commences falling when the root mean square value of the voltage is about 1.8 (Vrms) and ceases falling when the root mean square value of the voltage is about 2.1 (Vrms).

The low-temperature operating range 305 indicates a range for controlling the brightness of the liquid crystal display device at a temperature of 0° C. by using the power circuit shown in FIG. 3A. Further, the high-temperature operating range 304 indicates a range for controlling the brightness of the liquid crystal display device at a temperature of 40° C. by using the power circuit shown in FIG. 3A. The automatic temperature correction range 306 indicates a range for automatically correcting the brightness of the liquid crystal display device according to the temperature characteristic of the diode group 104 shown in FIG. 3A.

Figure 1:
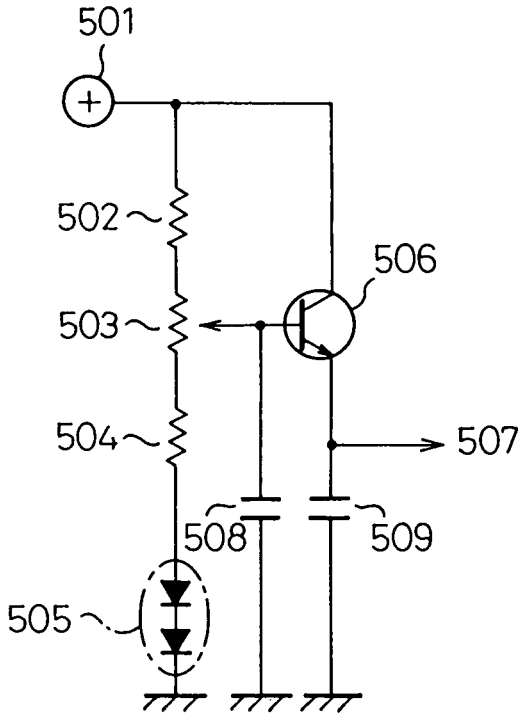
FIG. 1 is a circuit diagram showing the constitution of a conventional power supply circuit for driving a liquid crystal display device.
Figure 2:
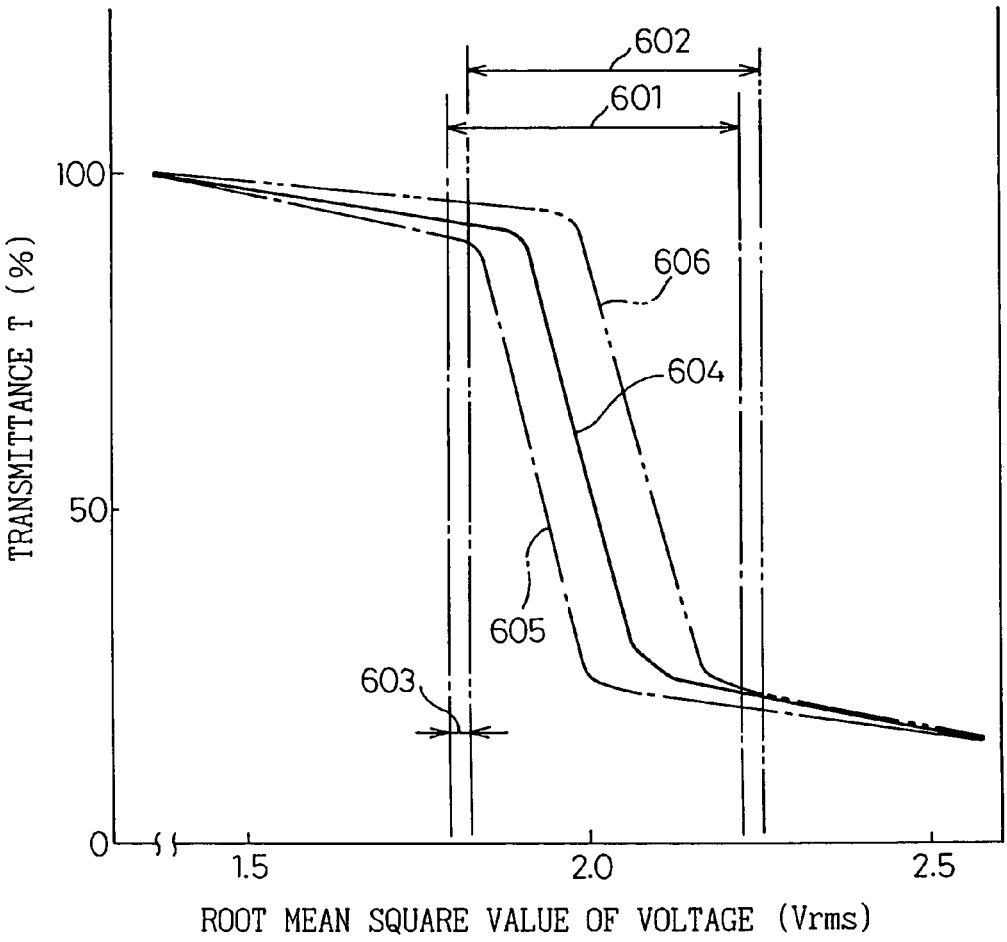
FIG. 2 is a graph showing characteristic curves, which are T-V curves of the liquid crystal display device employing the conventional power supply circuit, and high-temperature and low-temperature operating ranges respectively corresponding to the R-V curves of the liquid crystal display device employing the conventional power supply circuit.

As can be understood from the comparison between the automatic temperature correction range 306 of FIG. 5 according to the present invention and the automatic temperature correction range 603 of FIG. 2 in the case of the conventional power supply circuit, the range automatically controlled by the diode group 104 of the present invention is wide. In addition, since the range controlled by the variable resistor 124 is effective only in the narrow range around a central position of the steep characteristic of the T-V curve at each temperature, a user can easily adjust the brightness of the liquid crystal display.

Incidentally, the variation range of the automatic temperature correction range 306 is in close agreement with that of each of the low-temperature T-V curve 302 and the high-temperature T-V curve 303. That is, the transmittance adjusted to a point B on the high-temperature T-V curve 303 at a temperature of 40° C. is automatically changed into that corresponding to a point A on the low-temperature T-V curve 302 at a temperature of 0° C. Namely, the brightness adjusted at each temperature is automatically maintained, at almost the same level, even when the temperature changes.

Figure 6:
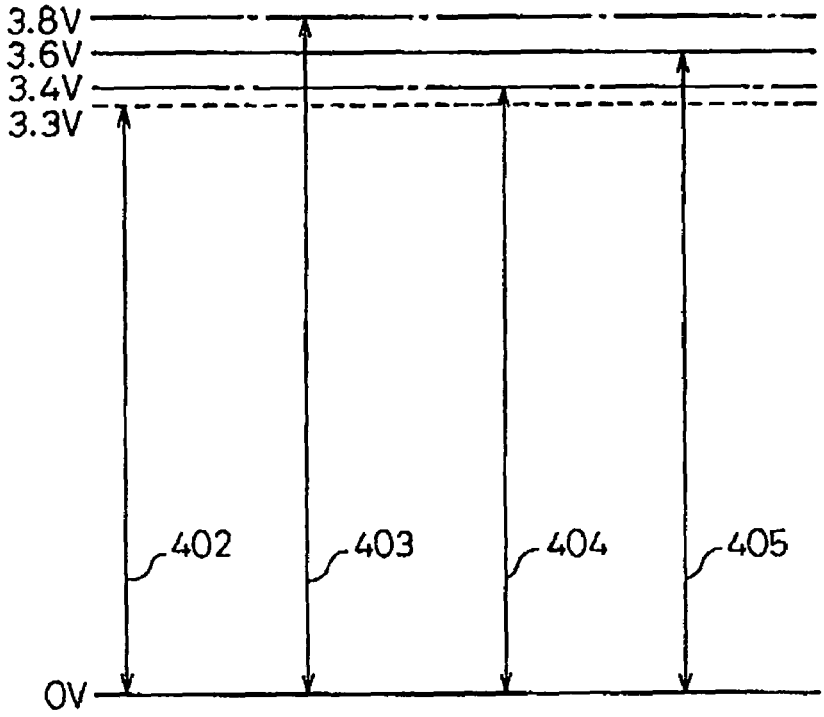
FIG. 6 is a diagram showing a power supply voltage of the present invention.

FIG. 6 is a diagram showing the relationship among voltages at the data drive circuit for illustrating reduction in the number of power supplies, which is another characteristic feature of the present invention. In this diagram, an input signal voltage range 402 is a range of the voltage level of a logic signal inputted from an external circuit. This range of the voltage is usually from 0 V to 3.3 V.

A low-temperature data drive voltage 403 is a power supply voltage for driving the data drive circuit at a temperature of 0° C., and is 3.8 V. A high-temperature data drive voltage 404 is a power supply voltage for driving the data drive circuit at a temperature of 40° C., and is 3.4 V.

In the case of the conventional power supply circuit, the power supply voltage for driving the data drive circuit at a temperature of 0° C. is about 5 V. Thus, an additional power supply or level shifter for supplying a voltage of 3.3 v is needed. In contrast with this, in the case of the power supply circuit of the present invention, 3.3 V., which is the voltage level of the input signal, is not less than 80% of 3.8 V, which is the low-temperature data drive voltage 403. Thus, the power supply circuit of the present invention can be used in common as a power source for driving liquid crystals.

Namely, one part of a power supply for the logic of the data drive circuit can be omitted in a range of temperature of 0° C. to 40° C.

Although seven series-connected silicon diodes are used as the diode group 104 in this embodiment, needless to say, it is easily devised that the number and kinds of the diodes are changed according to changes in the threshold voltage (Vthsi) of the silicon diodes, in the threshold voltages (VthLCD) of the liquid crystal, and in the range 402 of the voltage level of the input signal.

Moreover, although bipolar transistors are used as the amplifying elements in this embodiment, amplifying elements, such as field effect transistors (FETs), MOS transistors, or operational amplifiers, may be used instead of the bipolar transistors.

Thus, the power supply circuit of the present invention for driving a passive matrix liquid crystal display device can supply optimum voltages in a wide range, in which the function of assuring quality to a change in temperature is effective.

Although the preferred embodiments of the present invention have been described above, it should be understood that the present invention is not limited thereto and that other modifications will be apparent to those skilled in the art without departing from the sprint of the invention.

The scope of the present invention, therefore, should be determined solely by the appended claims.

What is claimed is:

1. A power supply circuit, which has a scan driver power circuit for supplying a scan driver voltage to a scan driver for scanning a liquid crystal display device, and which has a data driver power circuit for supplying a data driver voltage to a data driver for sending display data to said liquid crystal display device, comprising:

a brightness control circuit, provided in said scan driver power circuit, for controlling brightness of said liquid crystal display device by changing the voltage level of said scan driver voltage;

a voltage regulation circuit, provided in said data driver power circuit, for regulating the voltage level of said data driver voltage supplied to said liquid crystal display device to a predetermined value; and a temperature compensation circuit, provided in said data driver power circuit, for compensating a temperature characteristic of said liquid crystal display device by changing the voltage level of said data driver voltage; and wherein said data driver power circuit and said scan driver circuit each further include:

an input power supply serving as a universal power supply therefore;

an amplifying element having an input terminal connected to said input power supply, and having a control terminal and an output terminal from which the data driver power voltage is outputted;

wherein said data driver power circuit further includes an impedance element connected between said input power circuit and said control terminal of said amplifying element, said voltage regulation circuit and said temperature compensation circuit being connected to said control terminal of said amplifying element; and wherein said scan driver power circuit further includes:

a divider circuit, provided between said input power supply and the ground, for setting a voltage applied to said control terminal of said amplifying element; and a variable resistor element, provided between the dividing point of said divider circuit and the control terminal of said amplifying element, which comprise said brightness control circuit;

wherein said voltage regulation circuit and said temperature compensation circuit comprise a diode group including a plurality of series-connected diodes connected between said control terminal of said amplifying element and around wherein said series-connected diodes comprises an anode terminal connected to said control terminal of said amplifying element and a cathode terminal connected to the ground; and wherein said diodes of said diode group are silicon diodes.

2. The power supply circuit according to claim 1, wherein the number of diodes of said diode group is determined from the sum of the voltage drop of each diode being approximately equal to said data driver voltage.

3. The power supply circuit according to claim 2, wherein the number of diodes of said diode group is seven.

4. The power supply circuit according to claim 3, wherein said divider circuit comprises:

a resistor having a terminal connected to said input power supply; and a Zener diode having a cathode connected to said resistor and having an anode connected to ground.

* * * * *

UNITED STATES PATENT AND TRADEMARK OFFICE

CERTIFICATE OF CORRECTION

PATENT NO. : 6,999,058 B1
APPLICATION NO. : 09/492789
DATED : February 14, 2006
INVENTOR(S) : Takakazu Yano and Shigeru Morokawa It is certified that error appears in the above-identified patent and that said Letters Patent is hereby corrected as shown below:

Claim 1, col. 10, line 7, "around" should read --ground--.

Signed and Sealed this

Seventeenth Day of April, 2007

JON W. DUDAS
*Director of the United States Patent and Trademark Office*